US009226603B2

(12) United States Patent
Dimitrakos

(10) Patent No.: US 9,226,603 B2
(45) Date of Patent: Jan. 5, 2016

(54) ALL-ACRYLIC DISPLAY CASE

(71) Applicant: 2 Face Case, LLC, Wood Dale, IL (US)

(72) Inventor: Joanne B. Dimitrakos, Wood Dale, IL (US)

(73) Assignee: 2 Face Case, LLC, Wood Dale, IL (US)

( * ) Notice: Subject to any disclaimer, the term of this patent is extended or adjusted under 35 U.S.C. 154(b) by 0 days.

(21) Appl. No.: 14/316,913

(22) Filed: Jun. 27, 2014

(65) Prior Publication Data

US 2015/0022066 A1 Jan. 22, 2015

Related U.S. Application Data

(60) Provisional application No. 61/846,662, filed on Jul. 16, 2013.

(51) Int. Cl.

| | |
|---|---|
| ***A47F 7/22*** | (2006.01) |
| ***A47F 3/00*** | (2006.01) |
| ***A47F 7/03*** | (2006.01) |

(52) U.S. Cl.
CPC . *A47F 7/22* (2013.01); *A47F 3/005* (2013.01); *A47F 7/03* (2013.01)

(58) Field of Classification Search
CPC ..... A47F 7/22; A47F 3/005; E05D 3/02
See application file for complete search history.

(56) References Cited

U.S. PATENT DOCUMENTS

| | | | | |
|---|---|---|---|---|
| 5,483,905 | A * | 1/1996 | Johansson | 109/79 |
| 6,044,987 | A * | 4/2000 | Marcus et al. | 211/169 |
| 6,158,828 | A * | 12/2000 | Vacovsky et al. | 312/114 |
| 2005/0040741 | A1* | 2/2005 | Simmons | 312/245 |
| 2008/0180003 | A1* | 7/2008 | Alman et al. | 312/114 |
| 2009/0011151 | A1* | 1/2009 | Cruz | 428/13 |

* cited by examiner

*Primary Examiner* — Gary Hoge
(74) *Attorney, Agent, or Firm* — Perkins IP Law Group LLC; Jefferson Perkins

(57) ABSTRACT

A transparent display case system that includes transparent hinges and a transparent case body. The case body is rotatable along an axis which is in alignment with the hinges.

16 Claims, 6 Drawing Sheets

ALL-ACRYLIC DISPLAY CASE

BACKGROUND OF THE INVENTION

People often collect and display various sports memorabilia such as jerseys. Jerseys for hockey, football, baseball, soccer, basketball, and other sports are often collected and displayed. Many collectors' jerseys are autographed and have monetary as well as sentimental value; in particular, jerseys that have come into direct contact with a professional player can have significant monetary value. However, jersey displays are not limited to sports memorabilia collectors. Jerseys may be displayed by schools or arenas as tributes to high achieving players or teams or in bars or other public establishments.

Sports jerseys have identifying features on both sides, front and back, and often on one or both sleeves. These features include team logos, numbers, names, and commemorative patches or appliques. To display the jersey, the jersey is placed in a framed display in which only one side of the jersey is facing glass and the reverse side of the jersey faces the backing of the display case. Once in a framed display, the jersey cannot be removed easily or replaced with another jersey. Thus a need exists for a display case that allows both sides of a sports jersey to be displayed or viewed while still providing protection for the jersey and which additionally allows the jersey to be removed or replaced easily.

SUMMARY OF THE INVENTION

According to one aspect of the invention, a display case system is provided which may be used to display a sports jersey. The display case system comprises a transparent display case and hinges. A top hinge and a bottom hinge, both of which are transparent, are mounted on a wall or display surface. The transparent display case has a top panel and a bottom panel each with holes that accept a pin from the respective hinges. The display case may also have a front and a back panel and a first and second side panel. When the pins are inserted into the case, the case rotates on the hinges such that either the front or the back of the hockey jersey may be displayed at any time. In this embodiment the pins are on the hinges with the holes on the case, in other embodiments, the pins may be on the case with the holes on the hinges.

The present invention provides an advantage to non-transparent display cases in which only one side of the jersey may be displayed and framed display cases from which the jerseys cannot be removed. The present invention confers a further advantage in that almost all of the structure is fabricated of transparent material, minimizing the visual impact of the case and emphasizing its contents.

BRIEF DESCRIPTION OF THE DRAWINGS

Further aspects of the invention and their advantages can be discerned in the following detailed description, in which like characters denote like parts and in which.

DETAILED DESCRIPTION

The present invention provides a wall-mounted transparent display case system for use in displaying jerseys such as hockey jerseys. In the embodiment shown in FIG. 1, a transparent display case system indicated generally at 100 includes a transparent case body 102, a transparent top hinge 104 and a transparent bottom hinge 106. The case body 102 and hinges 104, 106 are preferably formed from optically clear cast acrylic sheets but may also be formed from transparent rubber, other transparent plastic or glass. While the illustrated embodiment is without color, other embodiments may fabricate one or more of the components from colored transparent acrylic and acrylic with decals or etching on the surface.

Figure 1:
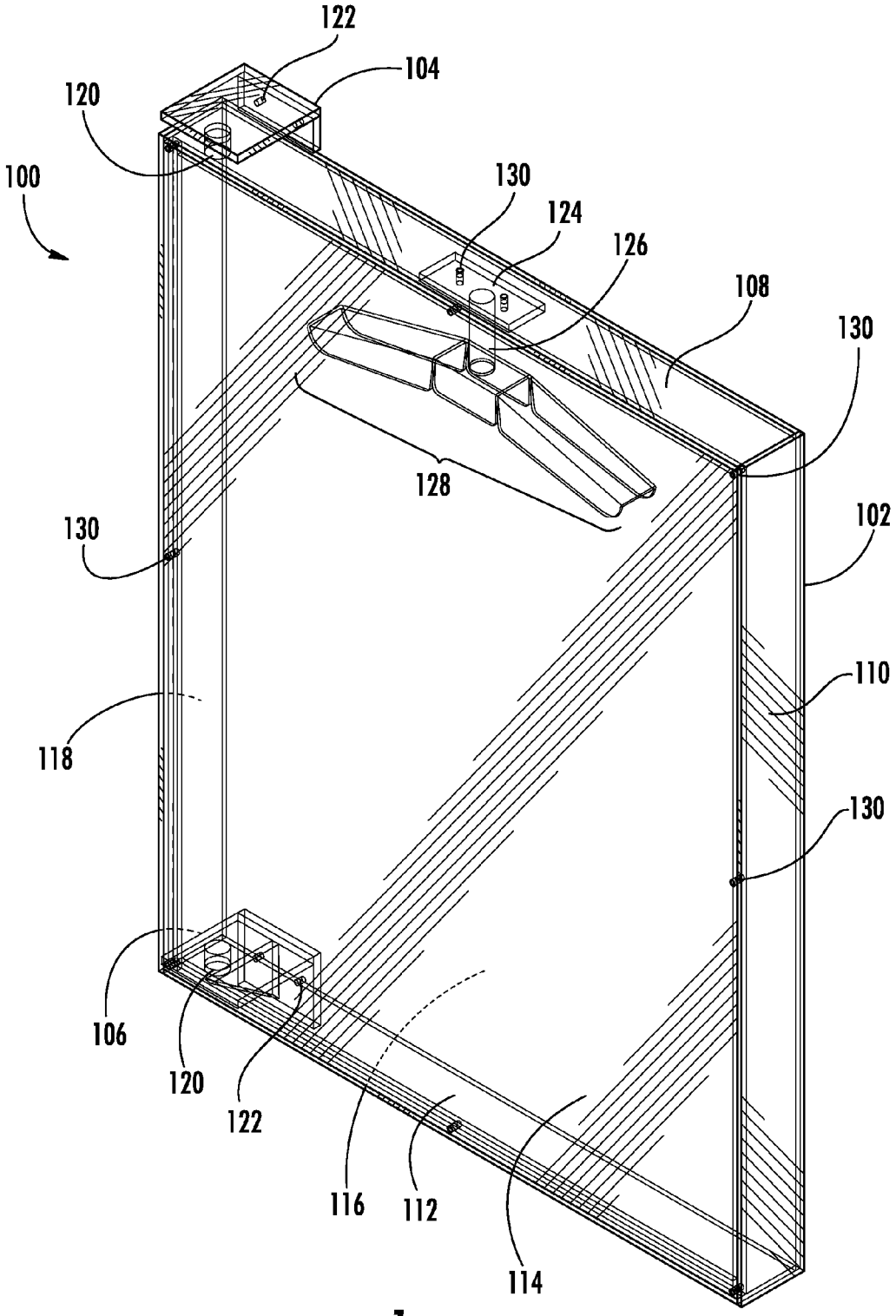
FIG. 1 is an isometric view of the system according to the invention.

As shown in FIG. 1, the transparent case body 102 fits between the transparent top hinge 104 and the transparent bottom hinge 106. The case body includes a transparent top panel 108 and a transparent bottom panel 112. In the illustrated embodiment, the case body 102 has a transparent front panel 116 which extends from a front side 134 of the bottom panel 112 and a front side 132 of the top panel 108. A transparent rear panel 114 is opposed to the front panel 116 and extends from a rear side 136 of the bottom panel 112 and a rear side 138 of the top panel 108. A transparent first side panel 102 extends from a first side of the top panel 108 and a first side of the bottom panel 112. A second side panel 118 extends from a second side of the top panel 108 and a second side of the bottom panel 112. The first and second side panels 102, 118 attach to the rear panel 114 and the front panel 116. These panels are preferably formed from optically clear cast acrylic sheets which can be 0.25 inch thick.

Figure 2:
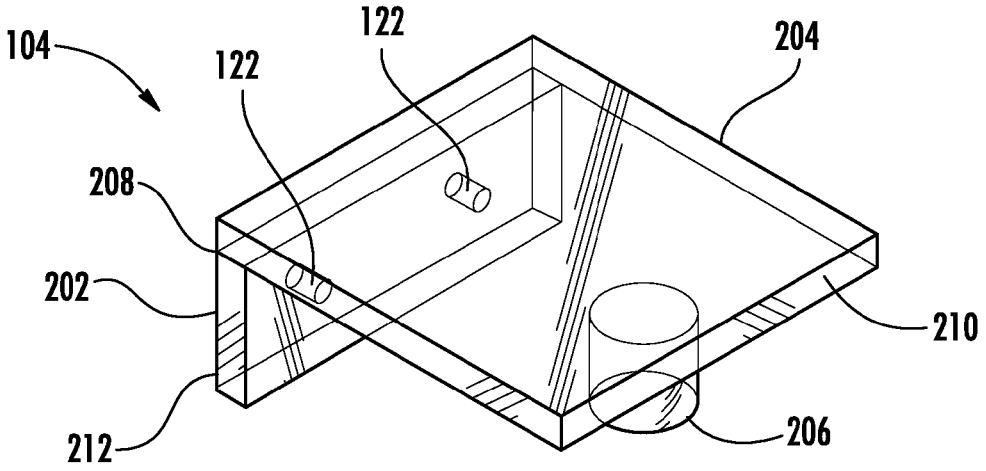
FIG. 2 is an isometric detail view of the top hinge.

As shown in FIG. 2, the top hinge 104 consists of a wall plate 202, a cantilever plate 204 and a first pin 206. In the illustrated embodiment the wall plate 202, cantilever plate 204 and the first pin 206 are all transparent. The wall plate and cantilever plate are preferably formed with optically clear cast acrylic of at least ⅜ inch thick, however, in further embodiments the wall plate may be formed with a transparent or opaque material.

The wall plate 202 is mounted to the wall or vertical platform in a position that is chosen by the user via laterally spaced apart screw holes 122. The screws placed in the hole may be oval or flat head Phillips Machine Screws with a length of at least approximately 0.5 inch and a 4-40 thread. In the illustrated embodiment the screws are transparent acrylic although further embodiments may use steel screws. The cantilever plate 204 is attached to the top edge 208 of the wall plate 202 with an adhesive, preferably a low VOC acrylic plastic cement such as SCIGRIP® 3. In the illustrated embodiment the first pin 206 is adhered to the bottom face 204 of the cantilever plate 210 via the adhesive. The first pin 206 is preferably made from optically clear cast acrylic rod with a diameter of one inch. Further embodiments may use different transparent material to form the first pin 206. In addition, further embodiments may use a first pin 206 of a larger or smaller diameter.

Figure 3:
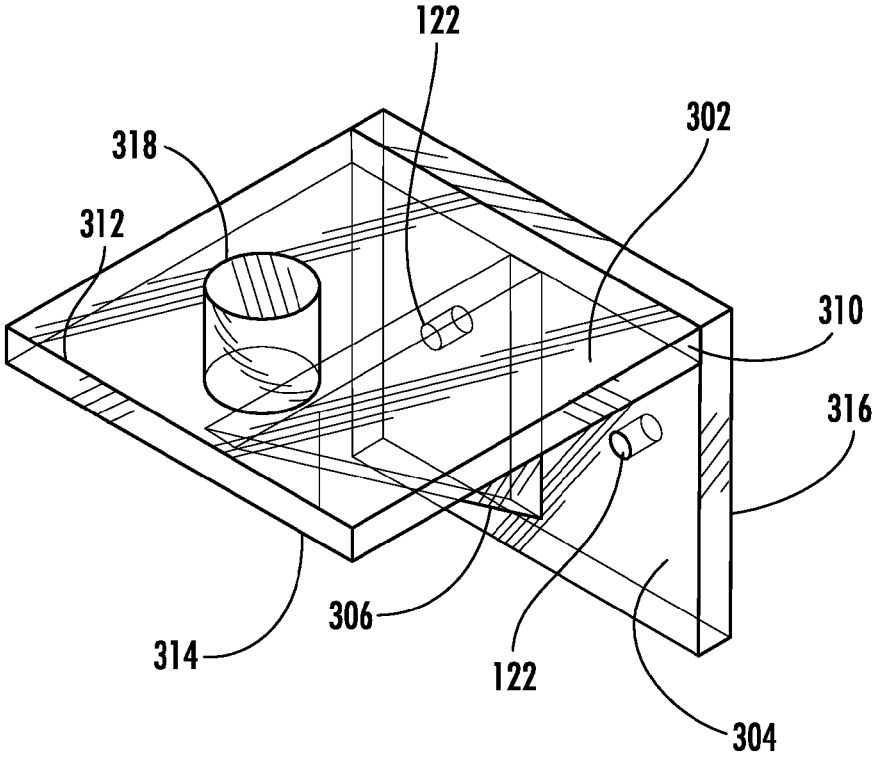
FIG. 3 is an isometric detail view of the bottom hinge.

As shown in FIG. 3, the bottom hinge 106 has a wall plate 304 that is transparent in the illustrated embodiment, however, the wall plate 304 may be formed of opaque materials in further embodiments. The wall plate 304 is mounted to the wall or surface by screws through two lateral spaced apart screw holes 122. The screws may be transparent or opaque oval or flat head phillips machine screws with a length of at least approximately 0.5 inch and a 4-40 thread. The cantilever plate 302 is attached to the front 310 of the wall plate 304 by adhesive, preferably a low VOC acrylic plastic cement such as SCIGRIP 3. The pin 308 is adhered to the top surface 312 of the cantilever plate 302 with the same adhesive. In the illustrated embodiment shown in FIG. 3, a transparent reinforcing bracket 306 provides additional support to the hinge 106. The reinforcing bracket 306 has a triangular shape with the right angle of the bracket nested in the right angle formed by the intersection of the cantilever plate 302 and the wall plate 304. The two legs of the triangular reinforcing bracket 306 extend along the wall plate 304 and the cantilever plate 302.

In FIGS. 2 and 3, the pins 206, 308 are spaced form the plate containing the rear wall plate surfaces 212, 316 by an amount (such as 3.625 inches) sufficient to permit the rotation of case body 102 without interference from the wall.

Figure 4:
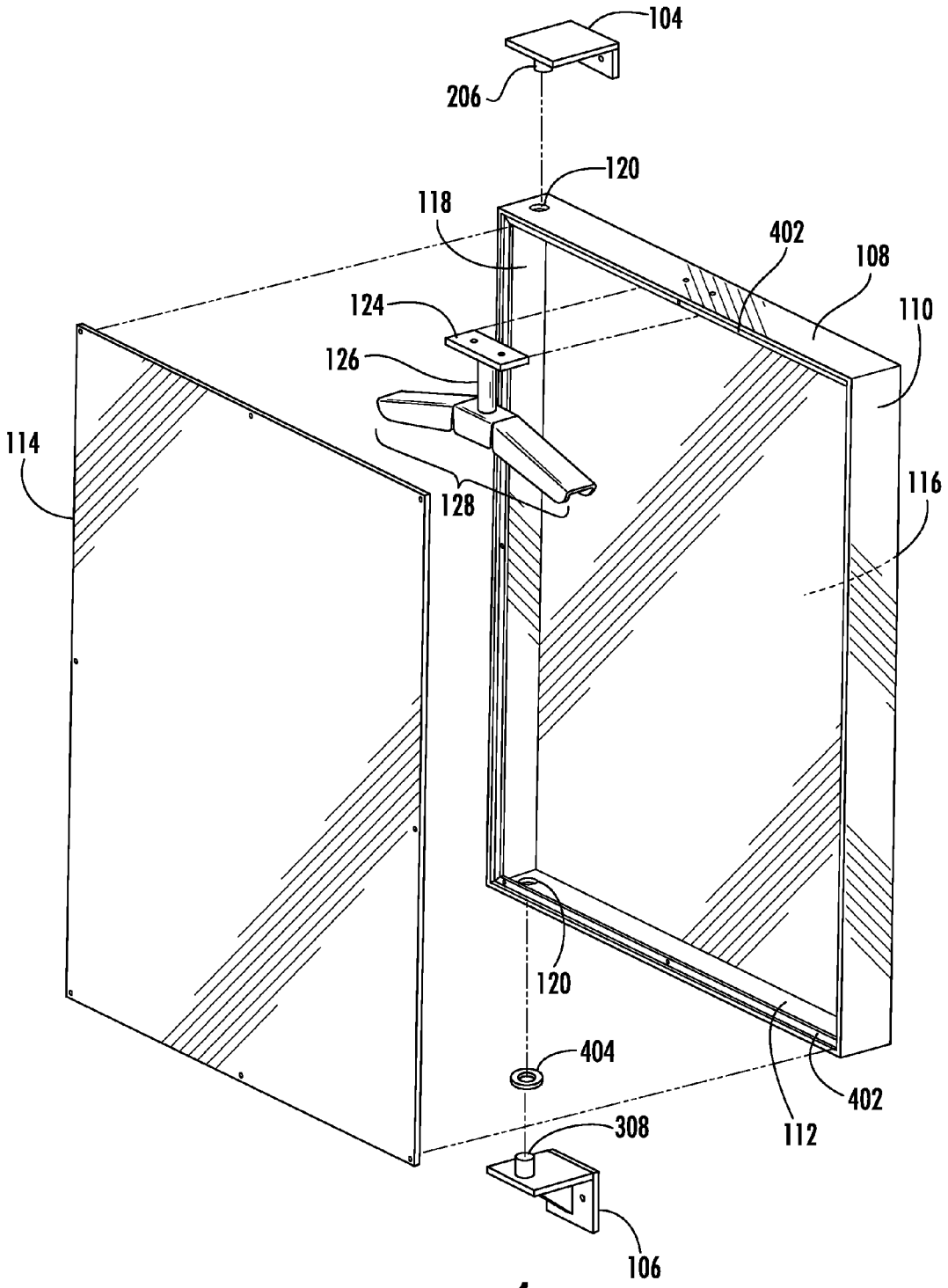
FIG. 4 is an exploded isometric view of the system.

As shown in the embodiment illustrated in FIG. 4, the top panel 108 has a hinge socket 120 extending downwardly from the top surface of the top panel 108 into which the pin 206 fits. In addition the bottom panel 112 has a corresponding hinge socket 120 which extends upwardly from the bottom surface of the bottom panel 112. In the illustrated embodiment sockets 120 extend all the way through their respective panels. The hinge sockets 120 are positioned on the top 108 and bottom 112 panels such that the display case may be rotated around a vertical axis x aligned with the pins 206, 308. In further embodiments a non-transparent steel thrust needle-roller bearing 404 may be placed on the cantilever plate 302 around pin 308.

To ensure that the display case body can rotate, the hinge sockets must be inset on the respective panels such that the case body does not come into contact with the wall and/or hinge. The exact placement of the hinge sockets is dependent on the extension of the cantilever panels 204, 302. For example, the hinge sockets center points may be approximately 1.5 inches from the edge of the top and bottom panels 108, 112 to provide adequate clearance for turning.

As discussed above, the system may additionally include a transparent front panel 116 and transparent back panel 114 which are attached to extend between the top and bottom panels 108, 112. The front panel 116 is adhered to the top 108 and bottom 112 panels and the first and second side panels 110, 118 by the adhesive. The back panel 114, however, is attached to a transparent flange 402 which has an approximate width of 0.5 inch. The flange 402 is inset from the respective edges of the top, bottom, first side and second side panels 108, 112, 110, 118 by approximately 0.25 inch and is attached by adhesive, preferably a low VOC acrylic plastic cement such as SCIGRIP® 3. The transparent flange 402 provides a surface for which screws (not shown) which fit into screw holes 130 (see FIG. 7) can secure the back panel 114 to the display case body 102. Accordingly, the back panel 114 acts as an access panel for the display case 100.

Figure 5:
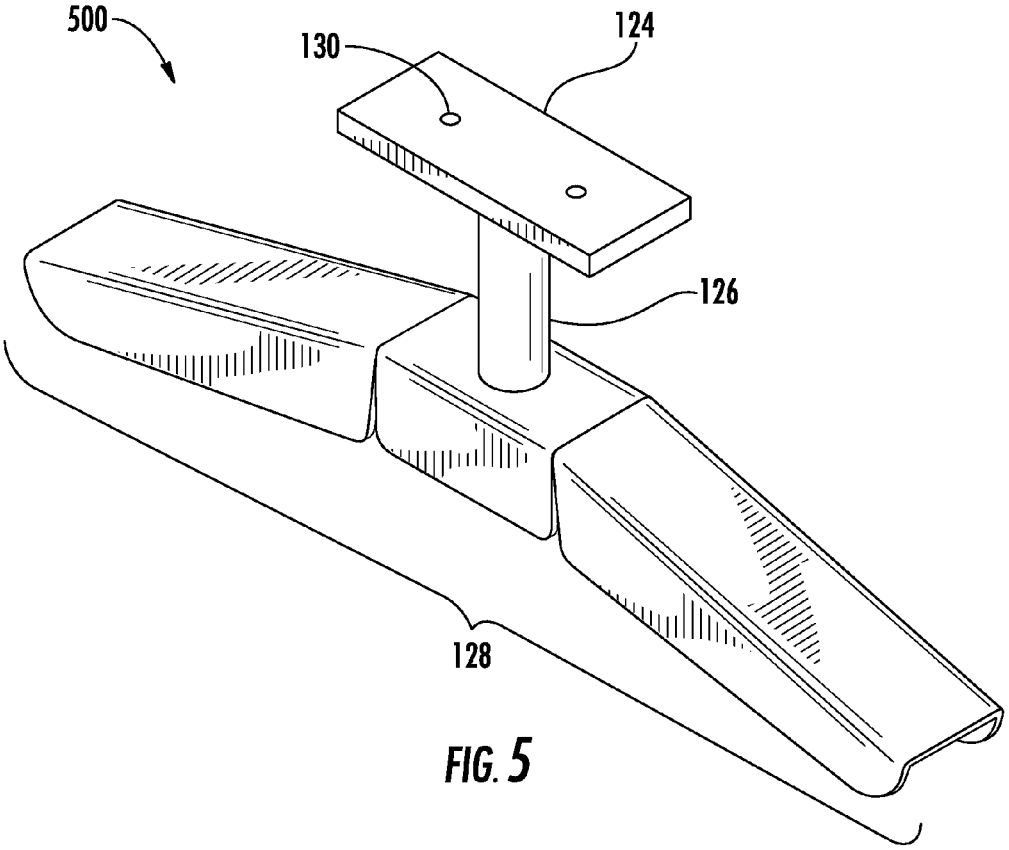
FIG. 5 is an isometric detail view of the transparent hanger assembly as shown in FIG. 1.
Figure 6:
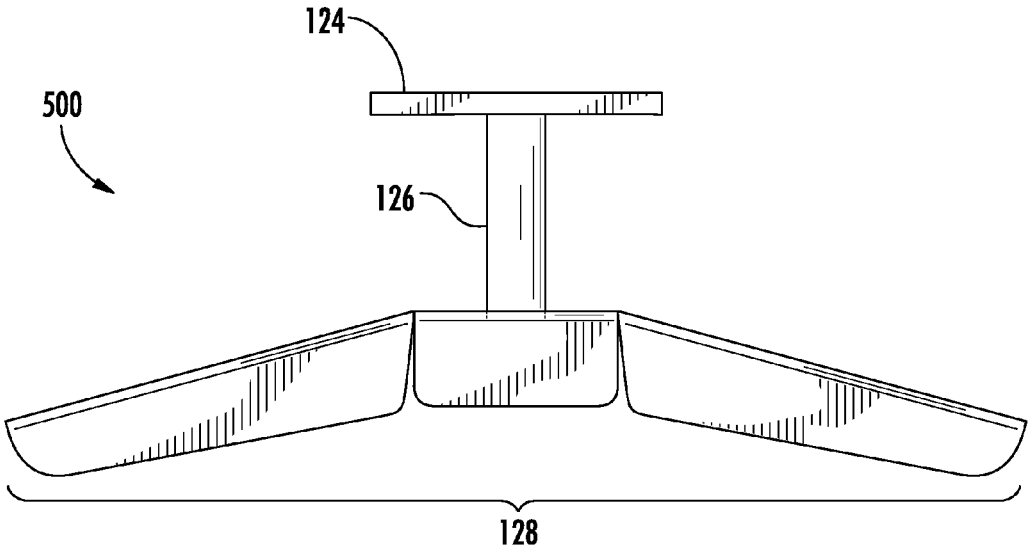
FIG. 6 is a side view of the transparent hanger assembly as shown in FIG. 1.

Further embodiments may have a transparent hanger assembly 500 as illustrated in FIGS. 5-6. The hanger assembly 500 has a mounting panel 124, a rod 126 and a support 128. The mounting panel 124 is attached to the lower surface of the top panel 108 by transparent screws 130 screws (not shown) which fit into screw holes such that the mounting panel 124 is approximately centered on the top panel 108. In the embodiment shown in FIG. 5, two screws are used to attach the mounting panel 124. Further embodiments may allow the mounting panel 124 to slide between guides or attach the mounting panel to the panel 108 by adhesive. The mounting panel 124 is preferably made of optically clear cast acrylic sheet that has a thickness of approximately 0.25 inch. A rod 126 is attached to the mounting panel 124 as by adhesive, preferably a low VOC acrylic plastic cement such as SCIGRIP® 3. A hanger 128 is attached to a lower end of the rod 126 with the rod 126 being in the approximate midpoint of the hanger 128. The hanger 128 is preferably made of transparent acrylic such as optically clear cast acrylic sheet. In the embodiment show in FIGS. 5 and 6, the hanger 128 is formed from one piece of acrylic or other clear thermoplastic material. To make the desired hanger 128, a clear sheet of acrylic is cut with a computer numerical control (CNC) router, to define a hanger top panel 502 and side panels 504 and 506. Once the shape has been cut, the acrylic is heated and bent to the desired shape. In the illustrated embodiment shown in FIGS. 5 and 6, the right, left and center top panels 502 of the hanger 128 all have the same width, yet the side extensions 504, 506 may be slightly angled to accommodate the shoulder line of jerseys and other sports clothing. As seen in the embodiments illustrated in FIGS. 5 and 6, there are no sharp corners in the hanger 128; rather the corners or edges are tapered. This is to prevent snagging and pulling, thereby preserving the integrity of the fabric.

Figure 7:
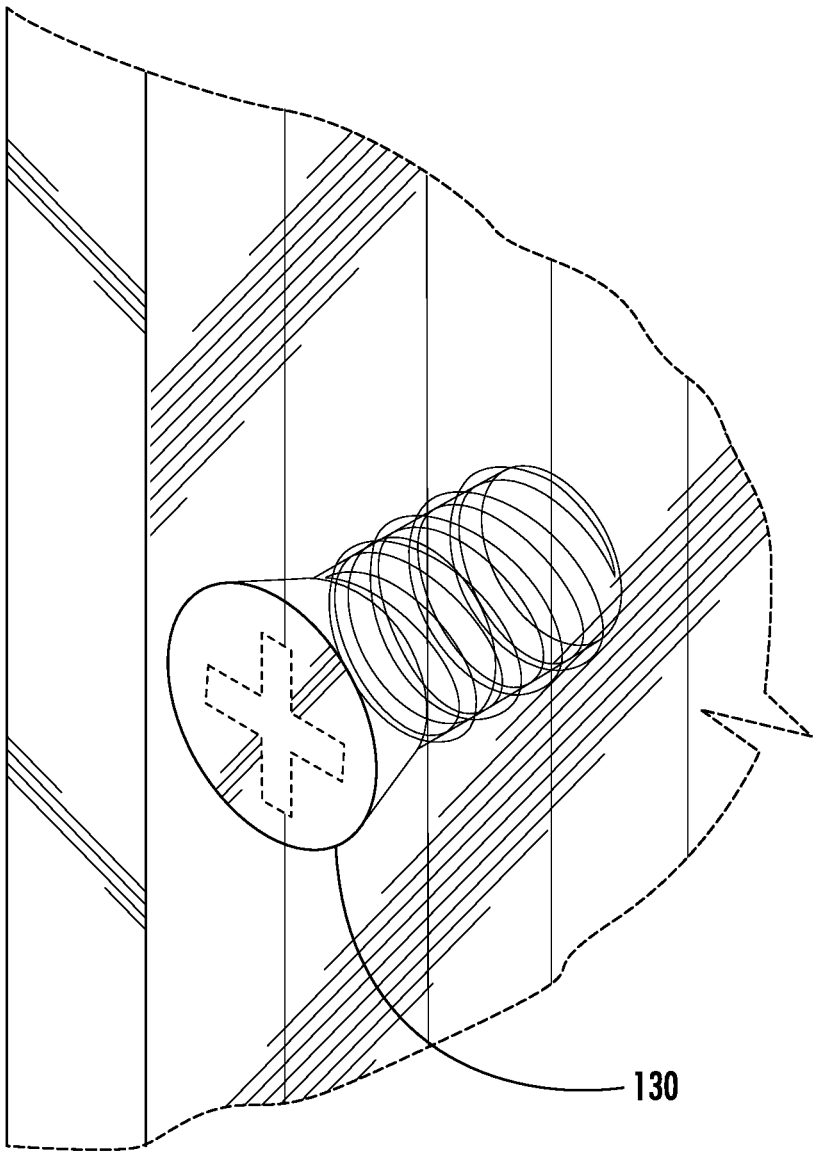
FIG. 7 is a detail view of a transparent screw used in a preferred embodiment of the invention.

FIG. 7 illustrates a representative transparent screw of the kind that preferably is used throughout. As outlined above, the screw 130 is preferably an oval or flat head Phillips Machine Screws with a length of approximately 0.5 inch and a 4-40 thread. Further embodiments may use steel screws.

Figure 8:
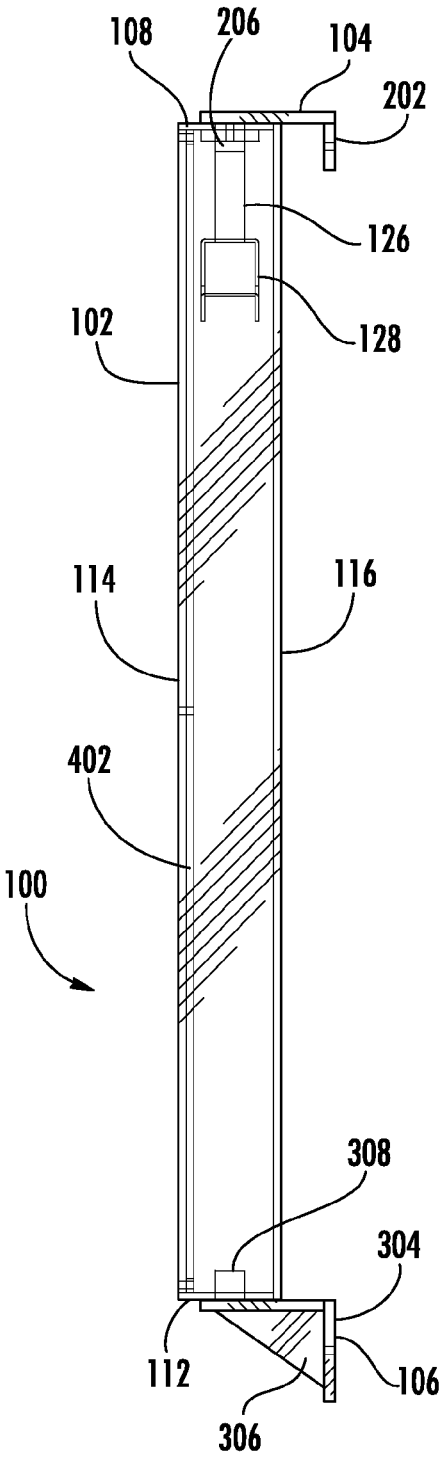
FIG. 8 is a side view of the system according to the invention.
Figure 9:
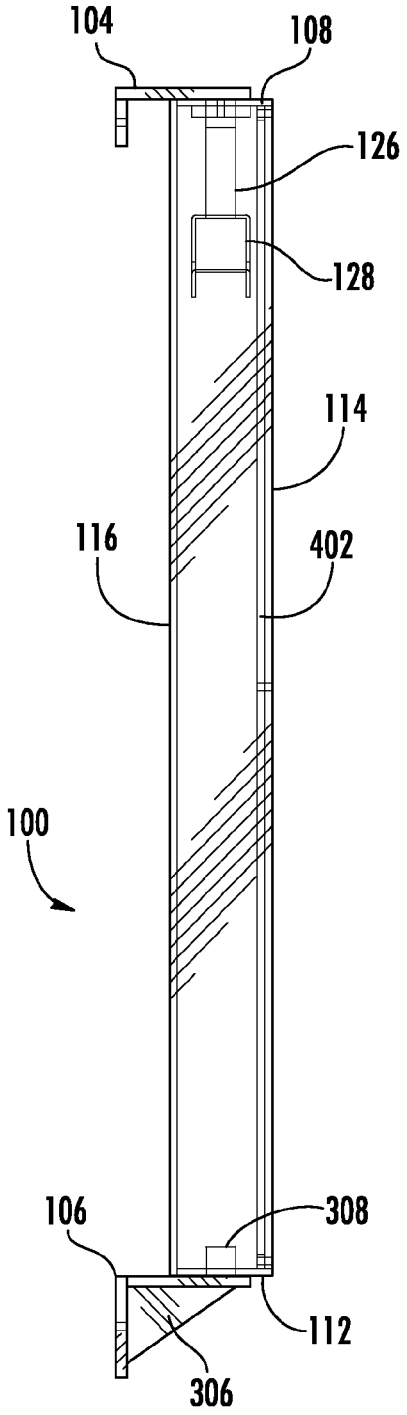
FIG. 9 is a side view of the system according to the invention, the side being opposed to the side in FIG. 8.

FIGS. 8 and 9 illustrate the transparent display case system 100 as viewed from the sides. FIG. 8 is the display case system as viewed from the hinge side. In this view, it is evident that the case body is spaced from both the top hinge wall plate 202 and the bottom hinge wall plate 304. The spacing is achieved by spacing the pins 206, 308 from the top and bottom hinge wall plates 202, 304. This spacing provides necessary clearance such that the case body 102 can rotate on an axis in alignment with the pins 206, 308. FIG. 9 illustrates the display case system 100 as viewed from the non-hinge side.

In summary, transparent display case systems have been shown and described which have a transparent case body and two transparent hinges that allow the case to rotate around an axis in alignment with the hinges. While illustrated embodiments of the present invention have been described and illustrated in the appended drawings, the present invention is not limited thereto but only by the scope and spirit of the appended claims.

I claim:

1. A system including a transparent display case and a pair of substantially transparent hinges for use in mounting the display case such that the display case can swivel, the system comprising:

a top hinge having a wall plate adapted to be mounted vertically, a transparent top cantilever plate joined to the wall plate and extending therefrom in a substantially horizontal direction, the top cantilever plate having an upper side and a lower side, a transparent first pin spaced from the wall plate and joined to the top cantilever plate, the pin vertically downwardly extending from the lower side of the top cantilever plate;

a bottom hinge having a wall plate adapted to be mounted vertically, a transparent bottom cantilever plate joined to the bottom wall plate and extending therefrom in a substantially horizontal direction, the bottom cantilever plate having an upper side and a lower side, a transparent second pin spaced from the wall plate of the bottom hinge, the pin joined to the bottom cantilever plate and vertically upwardly extending from the upper side of the extending plate; and a display case body having a transparent top panel with a top surface, a transparent bottom panel vertically spaced from and opposed to the top panel and having a bottom surface, a first hinge socket formed to extend downwardly from the top surface of the top panel, a second hinge socket formed to extend upwardly from the bottom surface of the bottom panel, the first and second hinge sockets sized to closely and rotatably receive the first and second pins respectively, the pins and sockets disposed around a vertical axis such that the display case body can be rotated around the axis.

2. The system of claim 1, wherein a second transparent reinforcing bracket is placed between the bottom hinge wall plate and the bottom cantilever plate.

3. The system of claim 1, wherein a needle roller bearing is disposed on the second pin.

4. The system of claim 1, wherein the top hinge wall plate is transparent.

5. The system of claim 1, wherein the bottom hinge wall plate is transparent.

6. The system of claim 1, wherein each of the first and second pin has a diameter of approximately one inch.

7. The system of claim 1, wherein each of the wall plates and cantilever plates are formed from an acrylic material with a thickness of approximately at least ⅜ inch.

8. The system of claim 1, wherein each of the first and second pin is cylindrical.

9. The system of claim 1, further including a transparent front panel attached to the top panel and the bottom panel a transparent back panel radially spaced from and opposed to the transparent front panel.

10. The system of claim 9, wherein the transparent front panel and the transparent back panel each are formed from an acrylic material with a thickness of approximately at least 0.25 inch.

11. The system of claim 9, wherein the transparent front panel and the transparent back panel are connected to the top and bottom panels with transparent screws.

12. The system of claim 1, wherein the transparent front and back panels are formed from an acrylic material with a thickness of approximately at least 0.25 inch.

13. The system of claim 1, further including a first transparent side panel, a second transparent side panel being radially spaced and opposed to the first transparent side panel.

14. The system of claim 13, wherein the transparent first and second side panels are formed from an acrylic material with a thickness of approximately at least 0.25 inch.

15. The system of claim 1, further including a transparent hanger adapted to hold a jersey, the hanger attached to the top panel with screws.

16. The system of claim 15, wherein the hanger comprises a mounting panel, a rod, and a support.

* * * * *